US006223489B1

(12) United States Patent
Fisher

(10) Patent No.: US 6,223,489 B1
(45) Date of Patent: May 1, 2001

(54) CONSTRUCTION BLOCK CAP

(76) Inventor: Myles A. Fisher, 2006 E. Mallory St., Pensacola, FL (US) 32503

( * ) Notice: Subject to any disclaimer, the term of this patent is extended or adjusted under 35 U.S.C. 154(b) by 0 days.

(21) Appl. No.: 09/328,017

(22) Filed: Jun. 8, 1999

(51) Int. Cl.[7] ..... E04B 5/46

(52) U.S. Cl. ..... 52/308; 52/300; 52/307; 52/244

(58) Field of Search ..... 52/300, 244, 308, 52/307, 293.2

(56) References Cited

U.S. PATENT DOCUMENTS

| | | | | |
|---|---|---|---|---|
| 2,233,308 | * | 2/1941 | Duffy | 72/86 |
| 5,031,372 | * | 7/1991 | McCluer | 52/307 |
| 5,778,620 | | 7/1998 | Fisher | 52/306 |
| 5,806,261 | * | 9/1998 | Huebner | 52/283 |
| 5,806,263 | * | 9/1998 | Coleman | 52/306 |

* cited by examiner

*Primary Examiner*—Carl D. Friedman
*Assistant Examiner*—Steve Varner
(74) *Attorney, Agent, or Firm*—Peter Loffler

(57) ABSTRACT

A construction block cap is used to cap the outer periphery of a construction block structure in order to permit the structure to be easily drop glazed into a frame. The construction block cap has a base member with a pair of flanges extending along and upwardly therefrom. A flange structure extends along and upwardly from the base member between the pair of flanges. The flange structure can be a single flange or a pair of flanges. The pair of flanges and the flange structure form a pair of parallel inner channels that receive the spacing flanges of the construction blocks used to make the construction block structure while the pair of flanges form a pair of outer channels that receive the cut edges of the cut faces of a construction block. Optional lips on the various flanges help hold the construction blocks in place and seal the structure within the frame.

10 Claims, 5 Drawing Sheets

CONSTRUCTION BLOCK CAP

BACKGROUND OF THE INVENTION

1. Field of the Invention

The present invention relates to a cap secured to construction blocks of a construction block structure to give the structure a generally uniform outer periphery.

2. Background of the Prior Art

Construction block structures, especially those made from glass and glasslike construction blocks, are very popular for use as doors, windows, and other partitions. These structures are made by combining several individual construction blocks to form the structure. Typically, the individual blocks will have some system that allows the block to be quickly and easily joined to other blocks. The problem this creates is that the outer periphery of the construction block structure is not generally uniform. As such, special framing must be used to hold the construction block structure in a stable and generally airtight fashion. This increases the overall cost of the construction block structure. Additionally, many structures are made wherein at least some of the blocks are cut leaving the cut edges of the cut blocks' faces as part of the outer periphery of the structure, adding additional complexity to the framing process.

Therefore, there is a need in the art for a device that allows a construction block structure to have a generally uniform outer periphery so that the structure can be placed into standard framing in normal fashion. Such a device must be of relatively simple and straightforward design and must be easy to install. The device must permit the construction block structure and frame to have a stable and relatively airtight fit.

SUMMARY OF THE INVENTION

The construction block cap of the present invention addresses the aforementioned needs in the art. The construction block cap is placed around the outer periphery of a construction block structure to give the structure a generally uniform outer periphery. This generally uniform outer periphery makes the structure similar to an ordinary pane of glass and allows the structure to be placed (drop glazed) into standard framing with relative ease. The structure remains within the frame in stable and relatively airtight fashion. The construction block cap is of relatively simple design and construction and is easy to install. The construction block cap is adapted to receive construction blocks that have spacing flanges of different widths between the flanges as well as the cut edges of cut construction blocks.

The construction block cap of the present invention is comprised of an elongate base member having a top surface, a bottom surface, a first end, and a second end. A first pair of flanges extend along the base member in parallel fashion, each of the first pair of flanges having a first (inner) face and a second (outer) face such that the two first faces face each other. A flange structure, which can be a single flange or a second pair of parallel flanges, extends along the base member between the first pair of flanges. An optional lip extends along each of the first faces of the first pair of flanges as well as along the faces of the flange structure that face the first faces of the first pair of flanges. The flanges are made from a relatively rigid material, such as vinyl, plastic, metal, wood, etc., to give structural integrity to the construction block cap once it is installed on the construction block structure. The lips can be made from the same material as their respective flange or from a resilient material such as rubber, neoprene, etc. At least one screw boss is located on one or both ends of the base member to allow two construction block caps to be joined at an angle to one another.

BRIEF DESCRIPTION OF THE DRAWINGS

Similar reference numerals refer to similar parts throughout the several views of the drawings.

DESCRIPTION OF THE PREFERRED EMBODIMENT

Figure 1A:
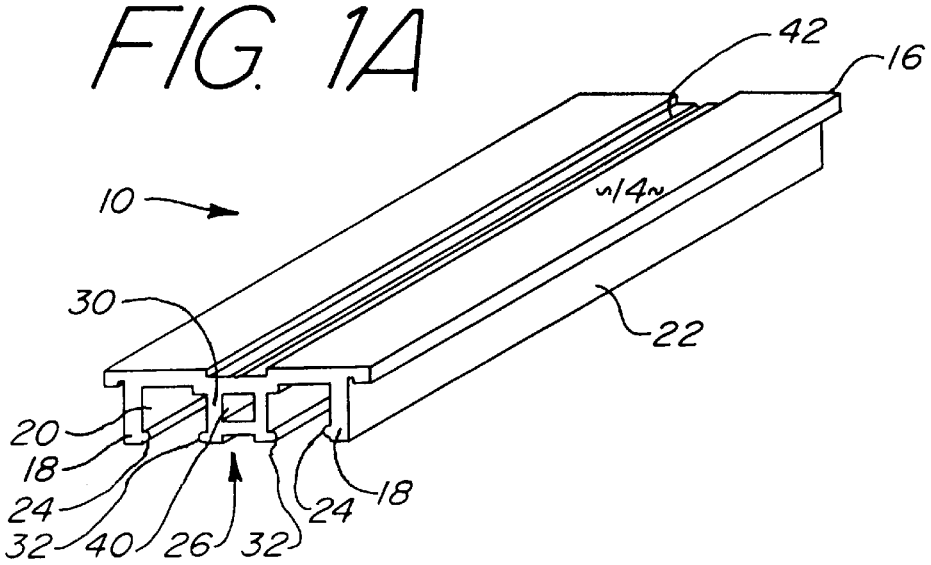
FIG. 1A is a perspective view of the construction block cap of the present invention with a flange structure utilizing a single flange.
Figure 1B:
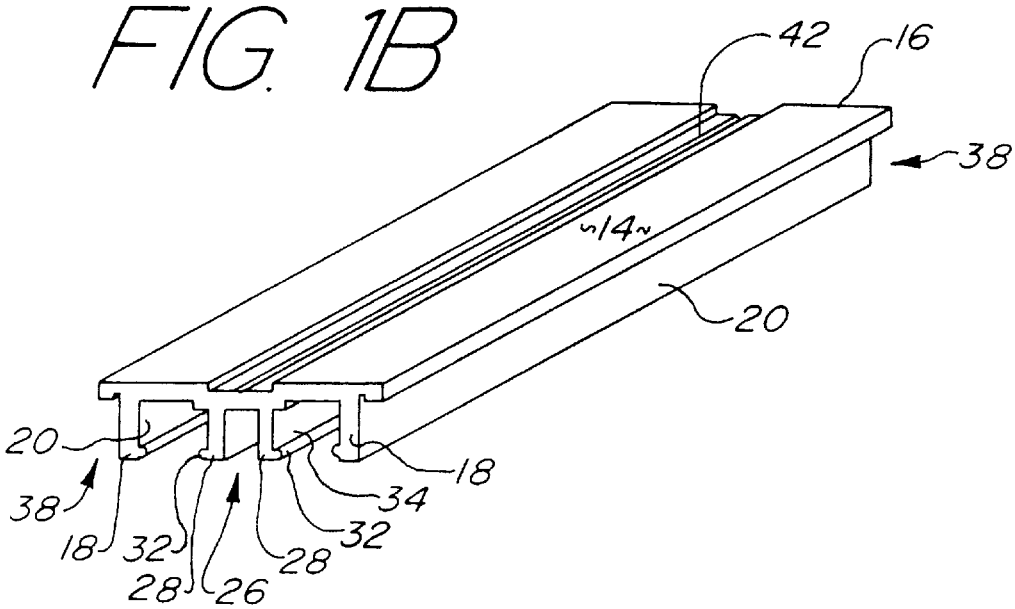
FIG. 1B is a perspective view of the construction block cap of the present invention with flange structure utilizing parallel flanges.
Figure 1C:
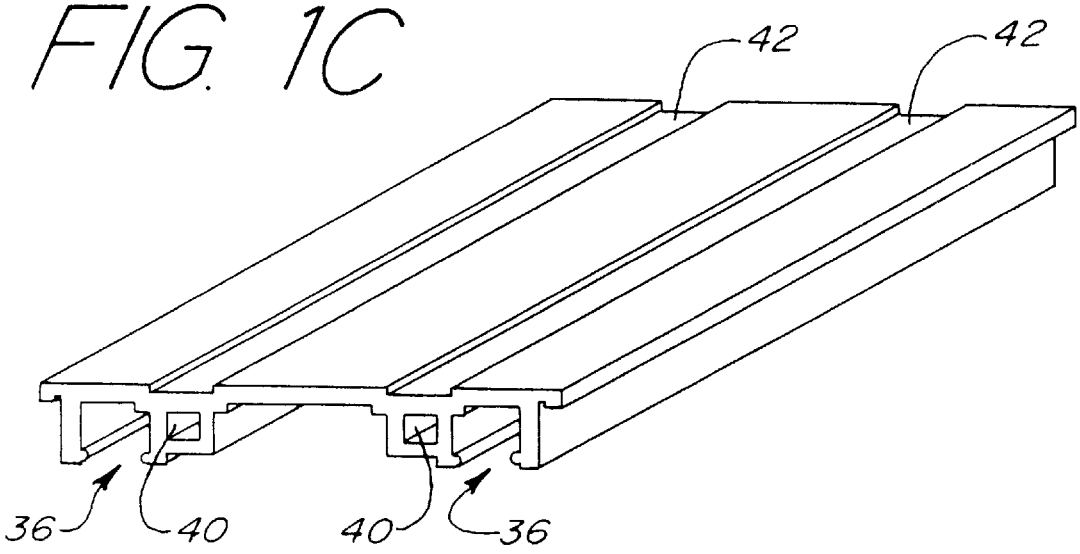
FIG. 1C is a perspective view of the construction block cap of the present invention with flange structure utilizing parallel flanges and dual screw bosses on each end.

Referring now to the drawings, it is seen that the construction block cap of the present invention, generally denoted by reference numeral 10, is comprised of an elongate base member that has a top surface 12, a bottom surface 14, and a pair of ends 16. A first pair of flanges 18, each having a first (inner) face 20 and a second (outer) face 22, extend along the base member. An optional first pair of lips 24 extend along each of the first faces 20 of the first pair of flanges 18. A flange structure 26 extends along the base member between the first pair of flanges 18. As seen in FIGS. 1B and 1C, the flange structure 26 can be a pair of parallel flanges 28, or as seen in FIG. 1A, the flange structure 26 can be a single wide flange 30. Optional lips 32 extend along each of the faces 34 of the flange structure 26 that face the first faces 20 of the first pair of flanges 18. The first pair of flanges 18 and the flange structure 26 define a pair of inner channels 36. Additionally, the second faces 22 of the first pair of flanges 18 define a pair of outer channels 38.

Figure 2:
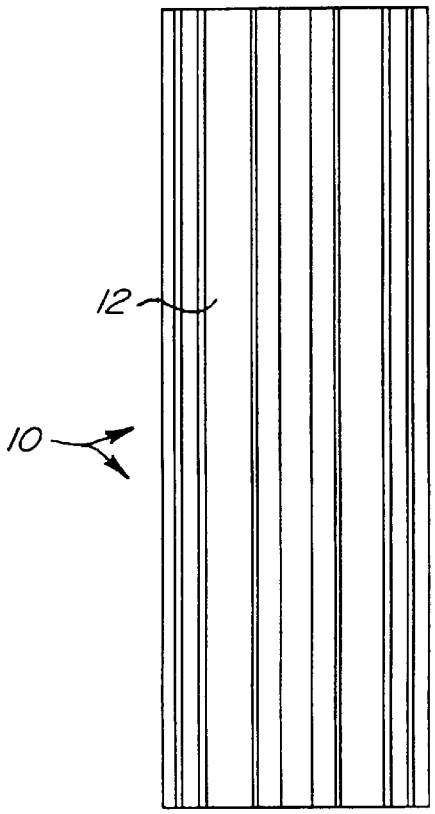
FIG. 2 is a top plan view of the construction block cap.
Figure 3:
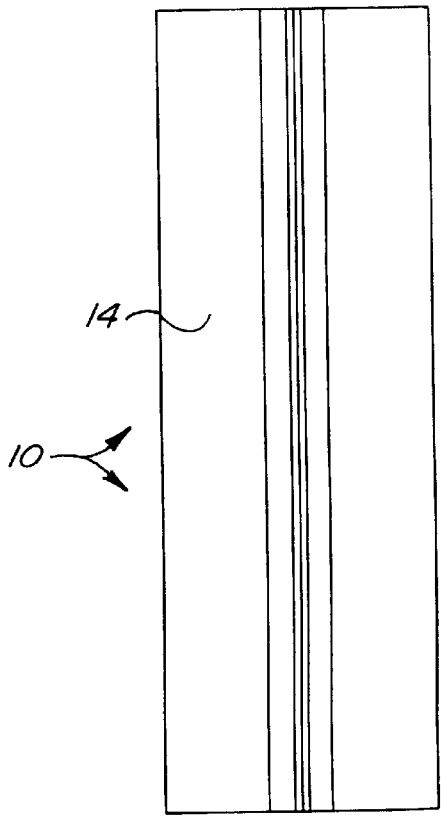
FIG. 3 is a bottom plan view of the construction block cap.

At least one screw boss 40 is located on one or both ends 16 of the base member (with a relatively wide construction block cap 10 as seen in FIG. 1C, 2 or more screw bosses 40 can be located at the ends 16). At least one valley 42 is located on the bottom surface 14 of the base member, generally opposite a screw boss 40 and each help align a screw with the screw boss 40 when two construction block caps 10 are joined at an angle.

The base member, the first pair of flanges 18, and the flange structure 26 are all made from a relatively rigid material, such as vinyl, plastic, metal, wood, etc., and can be formed by extrusion or other appropriate process. The lips 24 and 32 can be made from the same material as their respective flange or from a resilient material such as rubber, neoprene, etc.

In order to use the construction block structure 10 of the present invention, a bead of silicone or other adhesive may, but need not be placed into the inner channels 36 of the construction block cap 10 and the construction block cap 10 is positioned over the outer periphery of a construction block structure BS such that the inner channels 36 of the construction block cap 10 are positioned over the spacing flanges SF of the construction block B. The construction block cap 10 is then snapped into place. Additional construction block caps 10 are placed onto the block structure BS as needed (typically, but not necessarily one construction block cap 10 per side of the construction block structure BS). Each pair of construction block caps 10 that meet at a corner, can be screwed or otherwise attached to one another with the screw passing through the valley 42 of the base member of one construction block cap 10 and being received in the screw boss 40 of the other construction block cap 10. Once the entire outer periphery of the construction block structure BS has a construction block cap 10 placed thereon, the structure BS is ready to be placed into its frame as desired. Optional silicone or other adhesive can be placed into the outer channels 38 to assist in mating the construction-block-cap-bearing structure BS with the frame.

Figure 4:
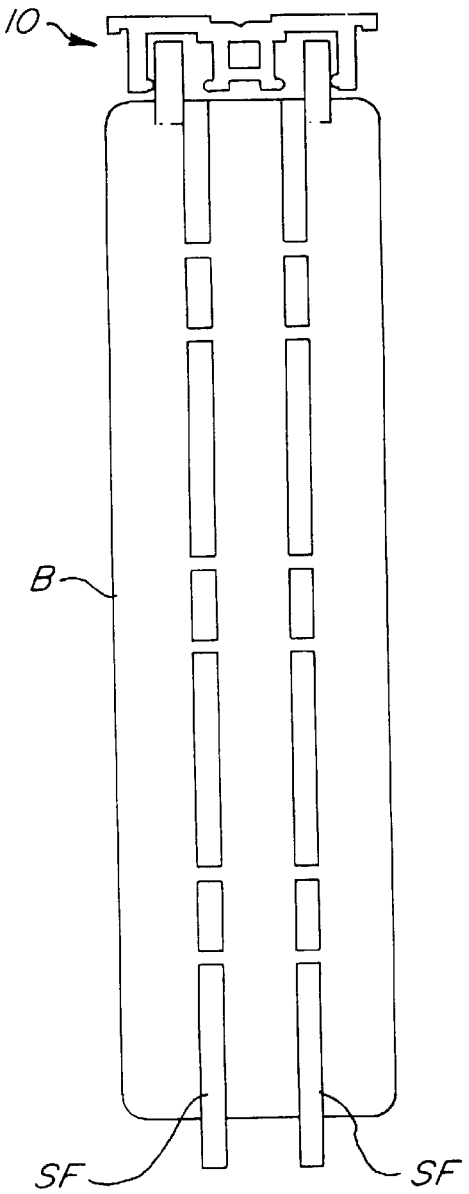
FIG. 4 is a side elevation view of the construction block cap receiving the relatively wide spacing flanges of a construction block.
Figure 5:
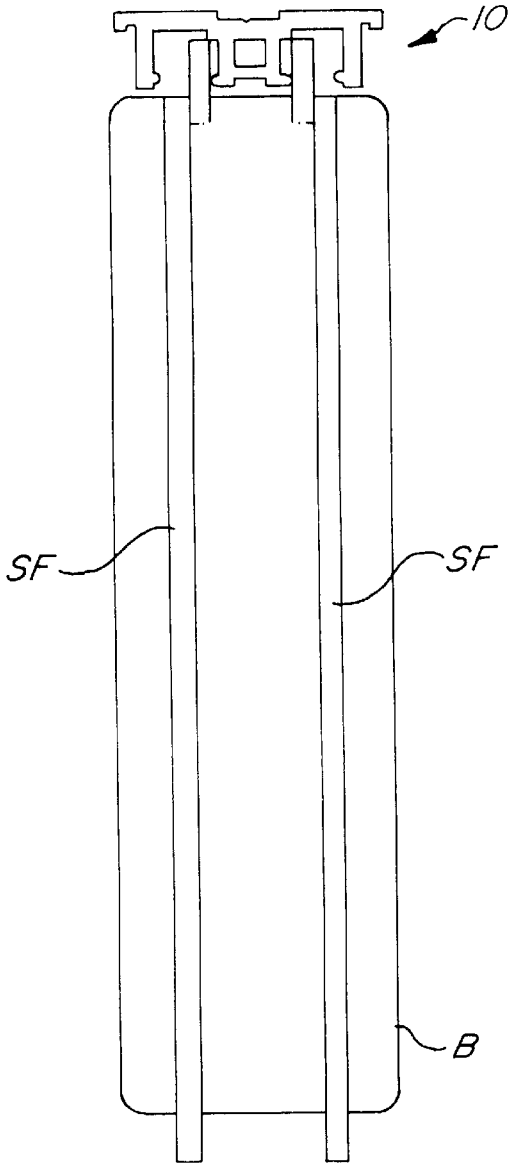
FIG. 5 is a side elevation view of the construction block cap receiving the relatively narrow spacing flanges of a construction block.
Figure 6:
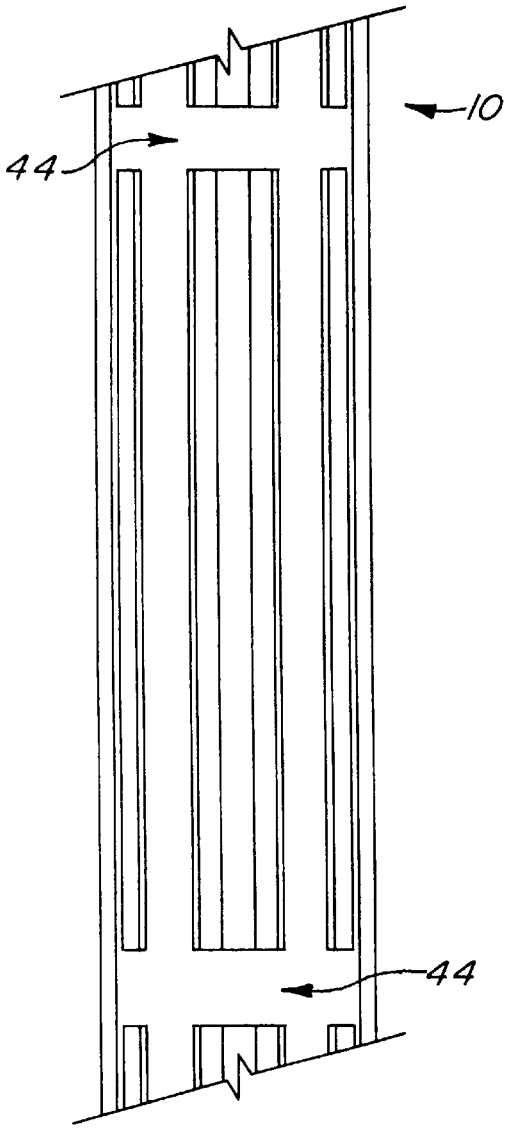
FIG. 6 is top plan view of the construction block cap having interrupts within the flanging system.
Figure 7:
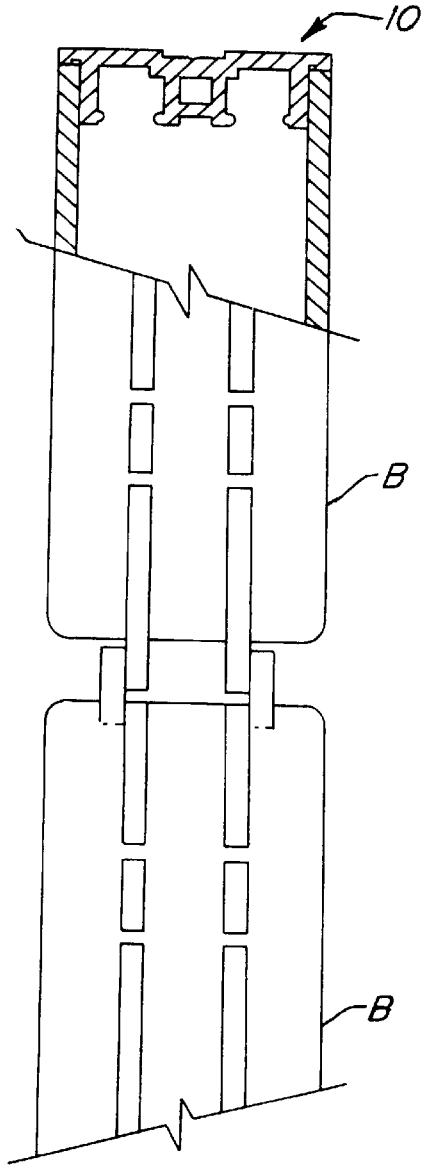
FIG. 7 is a side elevation view, partially sectioned, of the construction block cap receiving a cut construction block.
Figure 8:
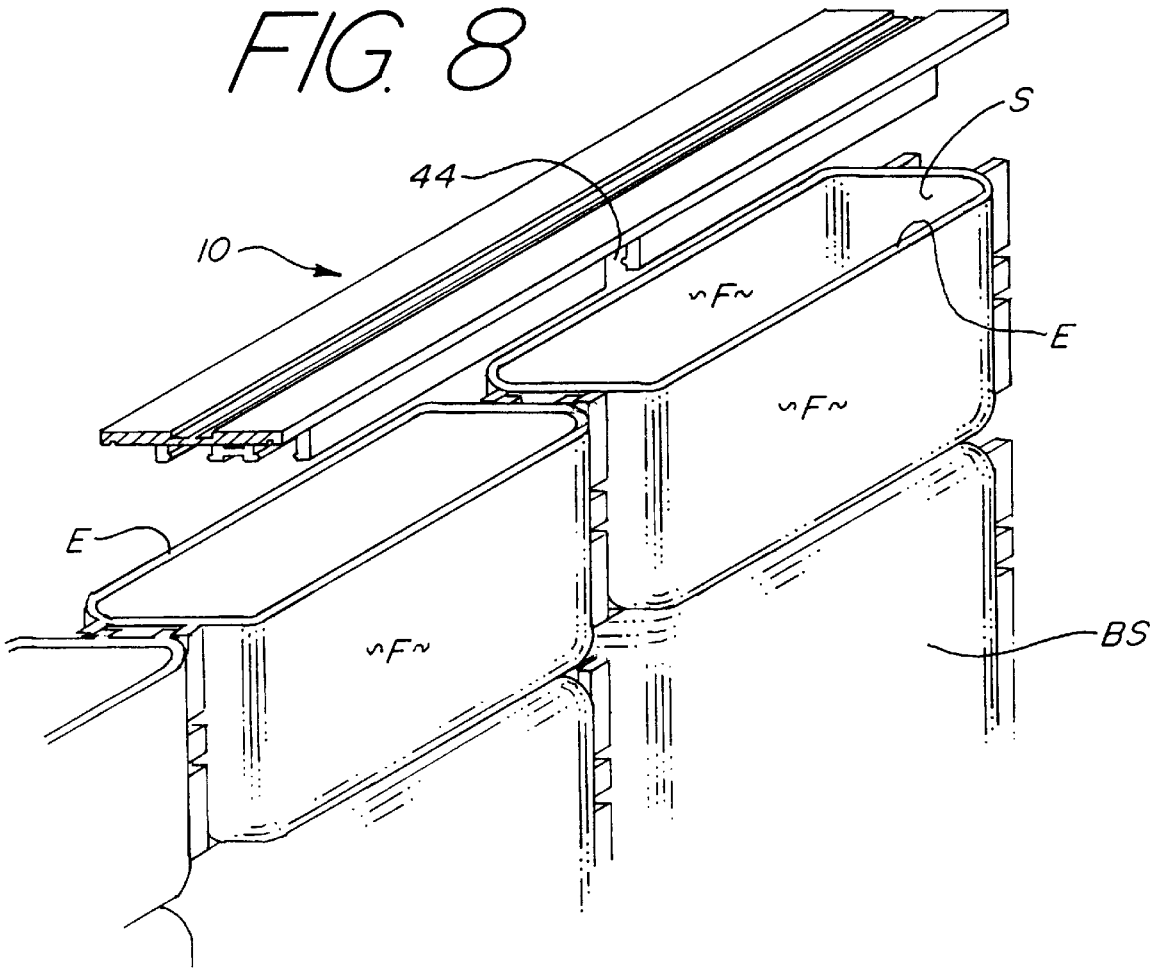
FIG. 8 is an environmental view of the construction block cap of FIG. 6 about to be placed onto a construction block structure.

The dimensions of the first pair of flanges 18 and the flange structure 26 are such that if the construction block B on the outer periphery of the construction block structure BS has relatively wide spacing flanges SF, then the first pair of flanges 18 engage the spacing flanges SF to secure the construction block cap 10 to the construction block structure BS (as seen in FIG. 4), and if the construction block B on the outer periphery of the construction block structure BS has relatively narrow spacing flanges SF, then the flange structure 26 engages the spacing flanges SF to secure the construction block cap 10 to the construction block structure BS (as seen in FIG. 5). This also permits the construction block cap 10 to be attached to a construction block structure BS wherein some of the construction blocks B on the outer periphery have relatively wide spacing flanges SF and some have relatively narrow spacing flanges SF. If the construction block cap 10 is to be placed onto a construction block B that has been cut, then the optional silicone or other adhesive is placed into the outer channels 38 and the construction block cap 10 is positioned so that the outer channels 38 are positioned over the cut edges E of the cut construction block B and the construction block cap 10 is snapped into place (as seen in FIG. 7). The first pair of flanges 18 abut the cut faces F of the construction block B and help prevent inward collapse of the faces F by providing support to the cut faces F. The construction block cap 10 has one or more interrupts 44 of the first pair of flanges 18 and the flange structure 26 in order to accommodate the sides S and their spacing flanges SF of the cut sides of the construction block B. This allows the cut sides S and their spacing flanges SF to be received within the interrupts 44 in a male (cut sides S and spacing flanges SF) female (interrupts 44) fashion.

If necessary, the construction block cap 10 is curved via an appropriate bending technique (the particular technique being material specific) in order to place the construction block cap 10 onto an outer periphery that is curved.

While the invention has been particularly shown and described with reference to embodiments thereof, it will be appreciated by those skilled in the art that various changes in form and detail may be made without departing from the spirit and scope of the invention.

What is claimed is:

1. An outer periphery construction block cap in combination with a construction block structure, the construction block structure having an outer periphery, the construction block cap comprising:

an elongate base member having a top surface, a bottom surface, a first end, and a second end;

a first pair of flanges extending along the base member, each of the first pair of flanges having a first face and a second face with the two first faces facing each other;

an additional flange structure extending along the base member between the first pair of flanges; and wherein the base member is attached to at least a portion of the outer periphery and at least one of the first pair of flanges or the flange structure engage the outer surface of the construction block structure and the first pair of flanges and the additional flange extend from only one surface of the base member.

2. The construction block cap as in claim 1 further comprising a lip extending along each of first faces of the first pair of flanges.

3. The construction block cap as in claim 1 wherein the flange structure is comprised of a second pair of flanges each of the second pair of flanges having a third face and a fourth face with the two third faces facing each other.

4. The construction block cap as in claim 3 further comprising a first lip extending along each of first faces of the first pair of flanges.

5. The construction block cap as in claim 4 further comprising a second lip extending along each of fourth faces of the second pair of flanges.

6. The construction block cap as in claim 1 wherein the flange structure is comprised of a second flange having a third face and a fourth face.

7. The construction block cap as in claim 6 further comprising a first lip extending along each of first faces of the first pair of flanges.

8. The construction block cap as in claim 7 further comprising:

a second lip extending along the third face of the second flange; and a third lip extending along the fourth face of the second flange.

9. The construction block cap as in claim 1 further comprising at least one screw boss located on at least one of the first end or the second end of the base member.

10. The construction block as in claim 1 further comprising at least one valley extending along the bottom surface of the base member.

* * * * *